United States Patent [19]

Fedison

[11] 4,052,490

[45] Oct. 4, 1977

[54] CARBURETOR WITH MANUALLY ADJUSTABLE FUEL SUPPLY

[75] Inventor: Walter W. Fedison, Ortonville, Mich.

[73] Assignee: Ford Motor Company, Dearborn, Mich.

[21] Appl. No.: 684,705

[22] Filed: May 10, 1976

[51] Int. Cl.[2] ..... F02M 7/08

[52] U.S. Cl. ..... 261/34 A; 261/67; 261/71; 138/45

[58] Field of Search ..... 261/71, 67, 68, 34 A; 138/45 A

[56] References Cited

U.S. PATENT DOCUMENTS

| | | | |
|---|---|---|---|
| 1,836,300 | 12/1931 | Zerbi | 261/68 |
| 1,981,483 | 11/1934 | Weber | 261/34 A |
| 3,210,054 | 10/1965 | Gettell | 261/34 A |
| 3,301,540 | 1/1967 | Walker | 261/69 R |
| 3,409,277 | 11/1968 | Reise | 261/71 |
| 3,911,062 | 10/1975 | Johnson | 261/34 A |
| 3,983,189 | 9/1976 | Taylor | 261/67 |

FOREIGN PATENT DOCUMENTS

| | | | |
|---|---|---|---|
| 583,733 | 9/1933 | Germany | 261/34 A |
| 230,043 | 3/1926 | United Kingdom | 261/71 |
| 1,322,570 | 7/1973 | United Kingdom | 261/71 |

*Primary Examiner*—Tim R. Miles

*Attorney, Agent, or Firm*—Robert E. McCollum; Keith L. Zerschling

[57] ABSTRACT

A carburetor has a manually adjustable control to simultaneously change fuel flow rates from the power valve and accelerator pump circuits to compensate for altitude changes varying the air density and thereby the air/fuel ratio of the mixture flowing from the carburetor.

7 Claims, 5 Drawing Figures

CARBURETOR WITH MANUALLY ADJUSTABLE FUEL SUPPLY

This invention relates, in general, to motor vehicle type carburetors, and more particularly to one in which additional fuel supplied by the carburetor auxiliary fuel circuits, such as, for example, the accelerator pump and power valve circuits, can be manually adjusted to compensate for changes in the air/fuel ratio due to operation at different altitudes.

Carburetors are known that have a manually adjustable power valve circuit to change fuel flow to compensate for a change in air density when operating the vehicle at altitudes that are different from that at which the carburetor was calibrated. For example, U.S. Pat. No. 3,301,540, B. Walker, Exterior Control Of The Power Valve Of A Carburetor, shows a bowden cable type control of a cam for varying the tension of the power valve spring in a carburetor so as to change the quantity of fuel flowing from the power valve.

The invention provides not only a manual control of the power valve fuel flow but simultaneously a control of fuel flow from the accelerator pump, combining in one operation control of various auxiliary fuel supply systems of the carburetor in a simple, mechanical, and economical manner.

It is a primary object of the invention, therefore, to attempt to maintain a chosen air/fuel ratio regardless of altitude changes by providing a carburetor with a manual, simultaneous adjustment of several auxiliary fuel supply circuits to change the fuel flow to compensate for changes in density of the air upon operation of the vehicle at altitudes different than those at which the carburetor auxiliary fuel circuits were originally calibrated.

It is another object of the invention to provide a carburetor of the above type with a single manual control to simultaneously change the fuel flow from the power valve and accelerator pump circuits.

It is a still further object of the invention to provide a carburetor with a manually adjustable valve adjacent the fuel bowl that is operably associated with both the power valve and accelerator pump circuits of the carburetor whereby movement of the valve simultaneously changes the flow of fuel through both circuits with a single stroke of the valve, to provide a simple, economical, altitude compensating type control for a carburetor.

Figure 4:
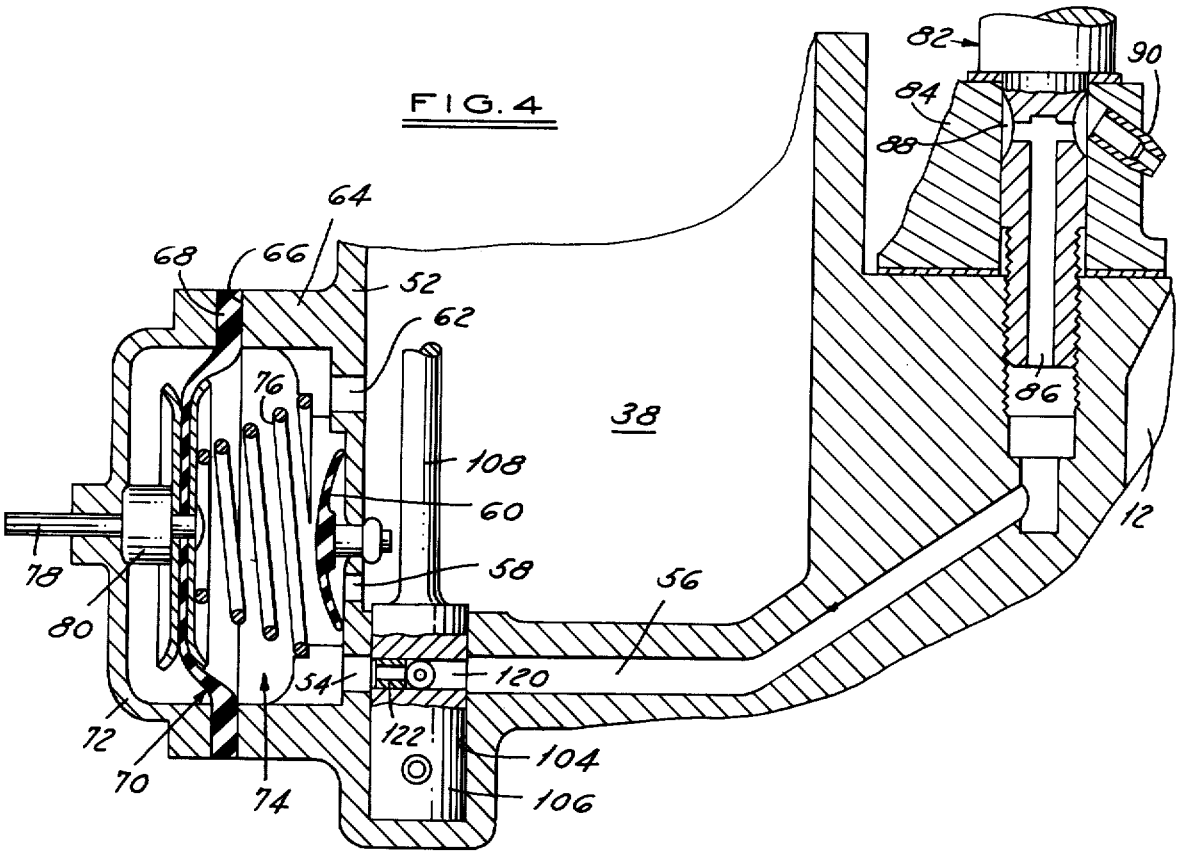
Figure 1:
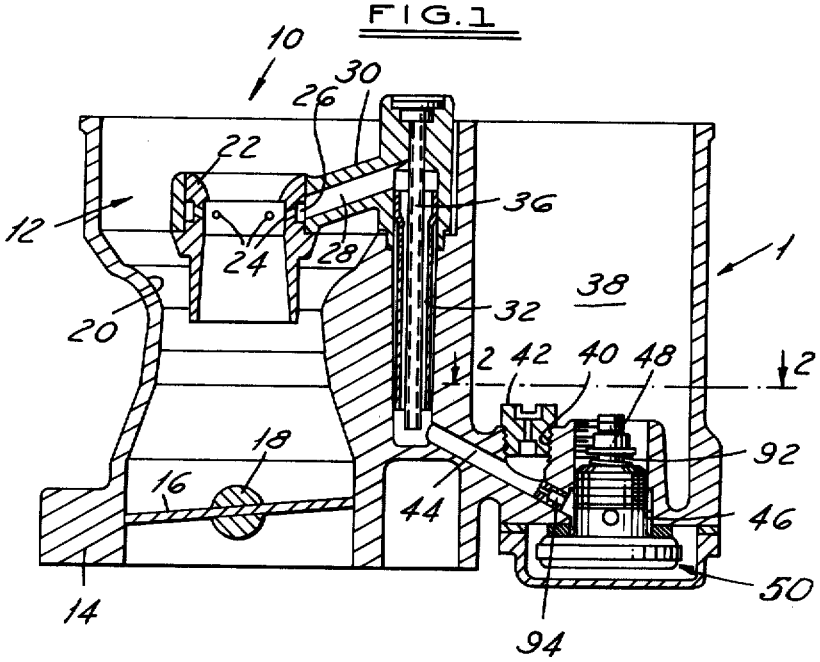
Figure 2:
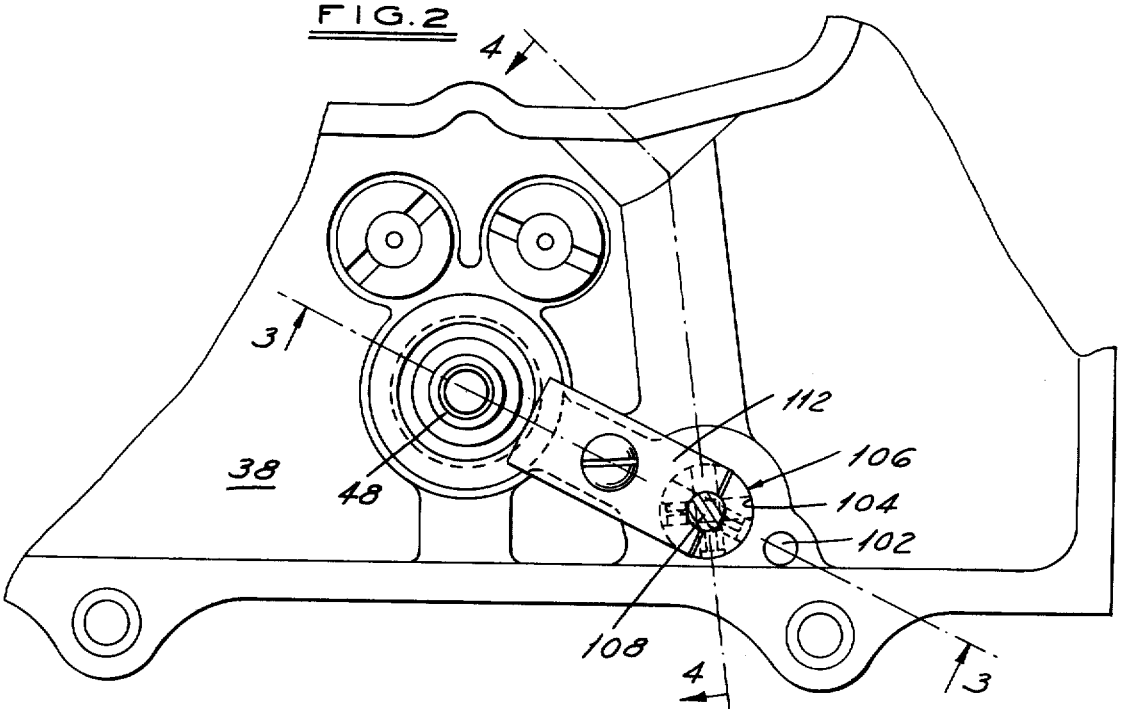
Figure 5:
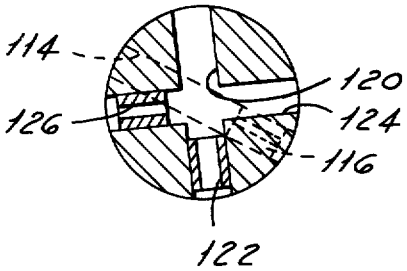
Figure 3:
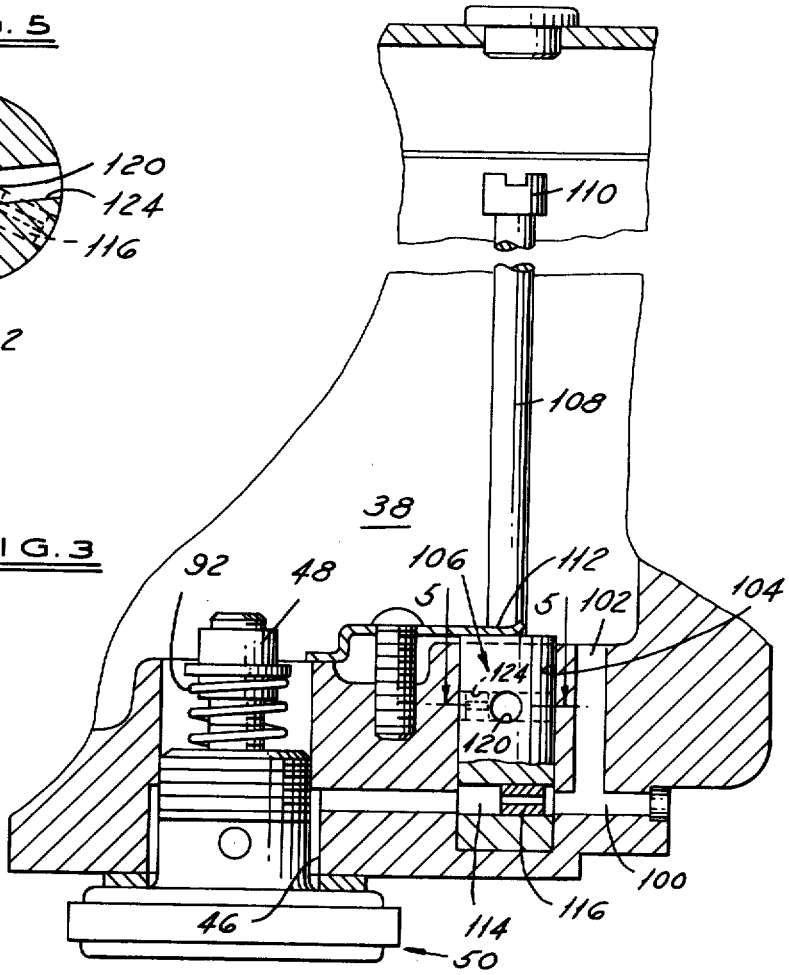

Other objects, features, and advantages of the invention will become more apparent upon reference to the succeeding, detailed description thereof, and to the drawings illustrating the preferred embodiment thereof; wherein, FIG. 1 is a cross-sectional view of the main body of a carburetor embodying the invention;

FIG. 2 is an enlarged plan view of a portion of the carburetor shown in FIG. 1 taken on a plane indicated by and viewed in the direction of the arrows 2—2 of FIG. 1;

FIGS. 3 and 4 are cross-sectional views taken on planes indicated by and viewed in the direction of the arrows 3—3 and 4—4, respectively, of FIG. 2; and, FIG. 5 is an enlargement of a detail shown in FIG. 2.

FIG. 1 shows the main body casting 1 of a known type of single barrel, downdraft carburetor 10. It has the usual main induction passage 12 that is open at its upper end to the air horn section (not shown) of the carburetor, and is flanged at its lower end 14 for connection to the intake manifold of an internal combustion engine, in the usual manner. A rotatable throttle valve 16, fixed on a shaft 18 rotatably mounted in the side walls of the carburetor, is movable from the closed position shown to a nearly vertical wide-open position to control the flow through induction passage 12.

The passage 12 is formed with the conventional fixed area venturi 20 within which is a boost venturi 22 having a plurality of main fuel inlet holes 24. The latter communicate with an annular fuel chamber 26 connected to a passage 28 through a strut 30 that supports the boost venturi. Passage 28 is connected to the vertical main fuel well 32 within which is located the usual emulsion tube 34. The latter consists of an outer apertured sleeve like tube within which is spacedly mounted an apertured air bleed tube 36. Tube 36 is open at its upper end to the atmosphere through an orifice, not shown.

The carburetor has the usual fuel bowl 38 at the bottom of which is located a main opening 40 controlled by a main fuel jet 42 of predetermined size. The opening connects to an intersecting passage 44 to the bottom of the fuel well 32, in a known manner. Also shown is the usual power valve cavity 46 for connecting additional amounts of fuel from fuel bowl 38 past the main jet 42 to fuel well 32.

More particularly, the power valve cavity 46 contains a valve 48 which when seated blocks flow of additional fuel from the fuel bowl 38 past the power valve to passage 44 in FIG. 1. The valve 48 is spring biased to an open position. In this particular instance, the lower portion of the power valve is connected to a vacuum actuated flexible diaphragm-type servo 50 that is connected to the induction passage at a location below the throttle valve so as to always be subject to manifold vacuum. Therefore, so long as the manifold vacuum remains above the force of the power valve spring, the valve 48 will remain closed and no additional fuel will be fed to main fuel well passage 44. As is known, during acceleration the decay in manifold vacuum permits the spring to open the power valve 48 and supply the additional quantity of fuel required at this time.

FIG. 4 shows the accelerator pump circuit of the carburetor. The outer wall 52 of fuel bowl 38 in this case is provided with a number of ports, 54 being a fuel discharge port connected to a passage 56, 58 being a fuel inlet port covered by a flexible umbrella type valve 60, and 62 being a vent to the space above the level of the fuel in the bowl 38. As shown, the fuel bowl casting is provided with a cup-shaped boss 64, the outer face portion 66 of which serves as a mounting for the outer edges 68 of a flexible annular disphragm 70. A cover 72 clamps the diaphragm 70 to boss 64.

The diaphragm 70 with the boss 64 defines a fuel chamber 74 which is filled with fuel through the inlet port 58 past umbrella seal 60 as the diaphragm moves leftwardly under the force of a spring 76. The fuel is pumped into the discharge port 54 and passage 56 by rightward movement of diaphragm 70 upon depression of the conventional vehicle accelerator pedal. The pedal moves an actuator slide member 78 directly against a stop member 80 riveted to retainers bracketing the diaphragm 70.

The discharge passage 56 is connected as shown to an accelerator pump shooter assembly 82 screwed into a central partition 84 of the carburetor body. The passage 56 connects through another passage 86 to an annular chamber 88 that in turn is connected to a number of circumferentially spaced fuel shooters or nozzles 90 for injecting slugs of fuel into the induction passage 12 adjacent the fixed area venturi shown in FIG. 1.

As thus far described, the construction is known. In operation, opening of the throttle valve causes flow of air through induction passage 12 to create a vacuum signal at the fuel ports 24 sufficient to cause an induction of fuel from the fuel well 32, which is replaced by flow of fuel through the main jet 42. Upon depression of the vehicle accelerator pedal, if the decay in manifold vacuum is sufficient, the power valve spring 92 will cause the power valve 48 to move upwardly. This will permit additional fuel flow from the fuel bowl through a restrictor 94 into passage 44 for flow to the fuel well 32, supplementing that fuel flowing through the main jet 42. At the same time, depression of the accelerator pedal moves the slide lever in FIG. 4 rightwardly to actuate the accelerator pump and discharge fuel through the passage into the nozzles 90 and therefrom into the main induction passage 12.

Turning now to the invention, as the altitude increases, the density of the air decreases. Unless this effect is negated, the air/fuel ratio will richen as the altitude increases, which may tend to increase emissions. The invention compensates for this change by providing a manually adjustable valve mechanism that simultaneously controls the fuel flow from the auxiliary power valve and accelerator pump fuel circuits so as to decrease the fuel flow in the circuits with increases in altitude. That is, the invention provides a manually adjustable means to vary the fuel flow in the auxiliary circuits of the carburetor.

As seen in FIG. 3, the bottom of the fuel bowl contains a horizontal passage 100 connected to power valve cavity 46. As seen in FIG. 1, the cavity is connected to the main fuel passage 44 past the restrictor 94. The power valve 48 per se in its closed position blocks the flow of fuel into cavity 46 until the force of spring 92 is able to overcome the manifold vacuum acting on the lower part 50 of the valve. However, the horizontal passage 100 in this case is supplied with fuel directly from the fuel bowl 38 through another passage 102. Intersecting the horizontal passage 100 is a round valve bore 104 that rotatably contains a valve member 106. The latter has a stem portion 108 with a slotted upper end 110 for a screw type rotational adjustment.

The valve 106 is located vertically by means of a forked retainer 112 overlying the top of the valve and straddling the stem portion 108. The lower land portion of the valve contains a straight through passage 114, which in this case, also contains a flow restricting orifice member 116. If desired, the restrictor may be eliminated. Also, it will be clear that different size restrictors may be used, if desired.

As seen in FIGS. 2 and 5, the passage 114 through the valve is shown as being aligned with horizontal passage 100, and that rotation of the valve will misalign the passages so that when so misaligned, fuel flow will be blocked. It wll be clear, of course, that if desired, instead of blocking the flow of fuel, another passage of smaller diameter can be aligned with the horizontal passage 100 to change the fuel flow. All that is required is that rotation of the valve cause a change in the fuel flow through the passage 100.

The accelerator pump circuit likewise is controlled by the rotatable valve 106 shown in FIG. 3. As seen in FIGS. 2 and 4, the accelerator pump discharge passage 56 is intersected by the valve bore 104, the valve 106 in this instance containing a second through passage 120 that at times aligns with the discharge passage 56 for controlling the fuel flow through this passage. In this instance, in the position indicated, the through passage 120 contains a restriction of flow restricting orifice 122 to predetermine the capacity or flow rate through discharge passage 56. Rotation of the valve 106 causes the through passage 120 to be misaligned with the discharge passage and another passage 124 containing a smaller orifice 126 to be then aligned with discharge passage 56 to again vary the fuel flow from the accelerator pump to the shooters 90. Again, it will be clear that the size of passage 120 and of the flow restricting orifices 122 and 126, and the question of whether total fuel should be blocked at times or not, will be a matter of choice and within the scope of the invention.

From the above, it will be clear that the manually adjustable valve simultaneously controls flow through both the power valve and accelerator pump circuits to lessen or increase fuel flow through these additional fuel flow circuits as the altitude changes to compensate for the change in density of the air. It will also be seen that the invention provides a simple, economical, and easily adjustable altitude compensating device that can be easily adapted to conventional carburetors with a minimum effort and expenditure and parts.

While the invention has been shown and described in its preferred embodiment, it will be clear to those skilled in the arts to which it pertains that many changes and modifications may be made thereto, without departing from the scope of the invention.

I claim:

1. A carburetor having an induction passage adapted to be connected to an engine intake minifold, a fuel bowl containing fuel, a first main conduit connecting the fuel bowl and induction passage for supplying the normal fuel requirements to the passage, a second conduit connected to the fuel bowl and operatively connected at times to the passage for supplying at times additional fuel to the passage, an accelerator pump connected to the fuel bowl, and third conduit means connecting the accelerator pump and passage for supplying further additional fuel to the passage in response to operation of the accelerator pump, and a single manually movable valve means operatively movably associated with both of the second and third conduits for simultaneously controlling flow of additional fuel through the second and third conduits to the passage.

2. A carburetor as in claim 1, including a power valve device, said second conduit means being connected through said power valve device to the induction passage.

3. A carburetor as in claim 1, the valve means having first passage means associated with the second conduit and second passage means associated with the third conduit, the valve means being movable to block or permit flow selectively through the passage means.

4. A carburetor as in claim 1, the valve means comprising a rotatable valve having a first through passage adapted to be aligned or misaligned with the second conduit as a function of rotation of the valve means, the valve having a second through passage means spaced from the first through passage means and adapted to be aligned or misaligned wth the third conduit means as a function of the latter rotation of the valve means, to control flow through the latter conduits.

5. A carburetor as in claim 4, including a third through passage means in the valve means adapted to be aligned with the third conduit upon rotation of the valve means to misalign the second through passage means with the third conduit, and flow restriction means in the third passage means.

6. A carburetor as in clam 1, including a power valve device connected to the fuel bowl at one end and to the main fuel conduit at the other end, a second valve normally closing the one end to block fuel flow through the power valve to the main fuel conduit, the second conduit connecting the fuel bowl to the main fuel conduit through a portion of the power valve and bypassing the second valve.

7. A carburetor having an induction passage open to air at one end and adapted to be connected to an engine intake manifold at the other end, a fuel bowl containing fuel, a main fuel conduit connecting the fuel bowl to the passage for the main induction of fuel into the engine, a power valve cavity connected to the fuel bowl at one end and to the main fuel conduit at the other end, a power valve normally closing the one end to prevent the supply of additional fuel to the main fuel conduit and movable to permit the latter supply, a bypass conduit connecting the fuel bowl and power valve cavity bypassing the power valve to permit the flow of the additional fuel to the main fuel conduit regardless of the position of the power valve, a multi-position rotatable valve associated with the bypass passage and having a passage means alignable with the bypass passage in one of the multi-positions of the valve to permit flow through the bypass passage to the induction passage and movable to another position to change the flow through the bypass passage, an accelerator pump operatively connected to the fuel bowl, a second conduit connecting fuel from the accelerator pump to the incuction passage, the rotatable valve also being associated with the second conduit and having a second passage means alignable at times with the second conduit in one of the multi-positions of the valve to permit flow of fuel from the accelerator pump to the induction passage and movable to another position to change the flow through the second conduit, the rotatable valve being manually rotatable to its different positions and simultaneously controlling flow through the first mentioned and second passage means.

* * * * *